United States Patent [19]

Eaby et al.

[11] 4,408,820

[45] Oct. 11, 1983

[54] ELECTRICAL TERMINALS FOR MODULAR WIRING SYSTEMS

[75] Inventors: Daniel G. Eaby, Mt. Joy; William B. Long, Camp Hill; John R. Shuey, Carlisle, all of Pa.

[73] Assignee: AMP Incorporated, Harrisburg, Pa.

[21] Appl. No.: 249,519

[22] Filed: Mar. 31, 1981

[51] Int. Cl.[3] ..... H01R 13/00

[52] U.S. Cl. ..... 339/156 R

[58] Field of Search ..... 339/95 D, 154, 156

[56] References Cited

U.S. PATENT DOCUMENTS

| | | | |
|---|---|---|---|
| 3,842,396 | 10/1974 | Olsson | 339/258 P |
| 4,146,287 | 3/1979 | Jonsson | 339/75 M |
| 4,219,868 | 8/1980 | Bowman | 362/147 |

*Primary Examiner*—Joseph H. McGlynn
*Assistant Examiner*—Timothy V. Eley
*Attorney, Agent, or Firm*—Adrian J. LaRue

[57] ABSTRACT

A T-shaped electrical junction connector having improved feed-through conductors and tap conductors therein is disclosed. The feed-through conductors comprise stamped rectangular plates each of which has three aligned openings extending therethrough. An elongated slot is formed in the feed—through conductors which intersects the openings. The metal of the conductor on each side of the slot is coined outwardly from the plane of the feed-through conductor to form a cylindrical surface which merges with one surface of the conductor. The tap conductors each comprise a cylindrical rod which is dimensioned to be inserted through one of the openings in the feed-through conductor and have an interference fit. The coined portions of the feed-through conductor are stressed in torsion when the tap conductor is inserted through the opening to enhance the contact force at the electrical interface. One or two of the tap conductors have laterally extending intermediate portions so that the free ends of the tap conductors will form a cluster so that the junction connector can be mated to a cylindrical tap connector.

8 Claims, 14 Drawing Figures

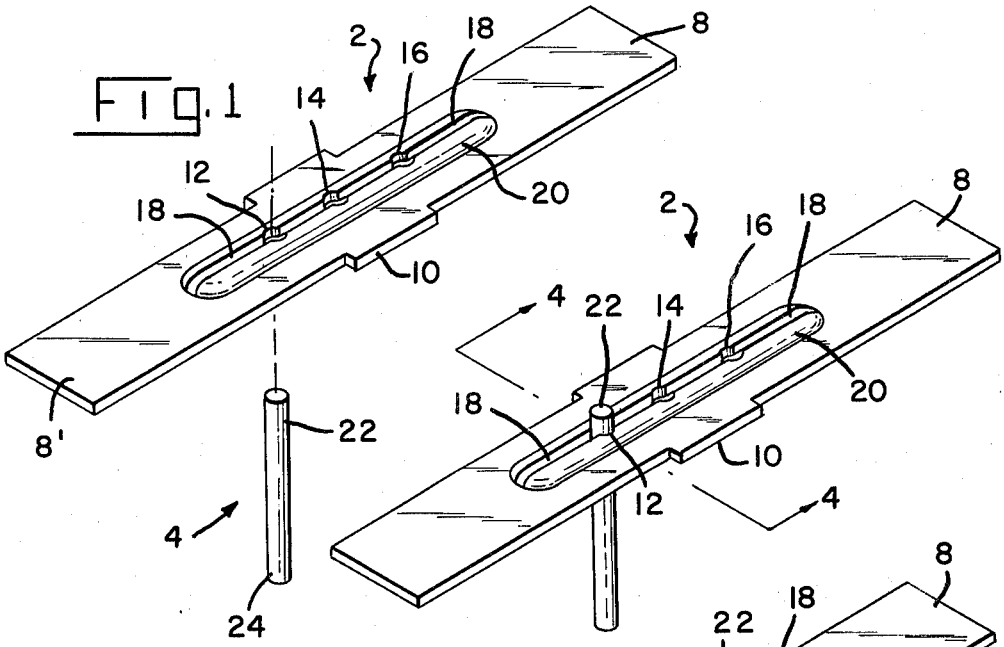
FIG. 1
FIG. 2
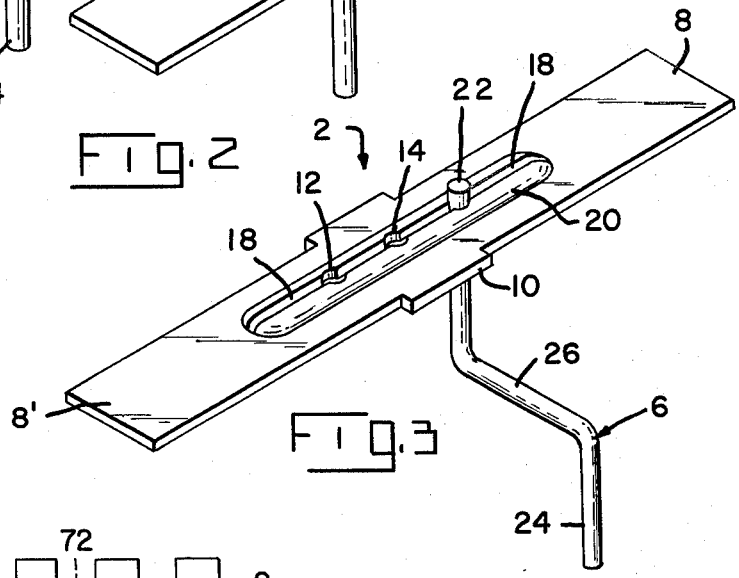
FIG. 3
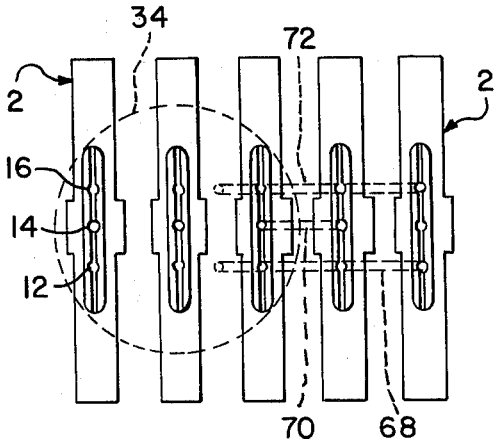
FIG. 5
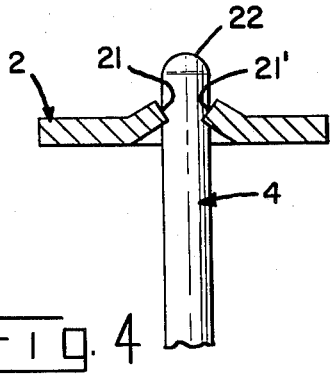
FIG. 4

ELECTRICAL TERMINALS FOR MODULAR WIRING SYSTEMS

FIELD OF THE INVENTION

This invention relates to T-shaped electrical junction connectors having improved feed-through and tap conductors therein. The feed-through and tap conductors may be used with a junction connector housing as disclosed in application Ser. No. 249,518, filed Mar. 31, 1981, or with other types of junction connector housings.

BACKGROUND OF THE INVENTION

It has become common practice to provide the electrical wiring in buildings by means of modular wiring systems composed of electrical cables having cable connectors on their ends, T-shaped junction connectors, and tap connectors. The cable connectors are coupled to the junction connectors at locations where electrical outlets are required and a tap connector is coupled to the junction connector. Tap conductors in the junction connector extend from the feed-through conductors in the junction connector to the mating face of the tap connector so that the terminals in the tap connector are mated with terminals on the ends of the tap conductors in the junction connector. The terminals in the tap connector in turn are connected to wires which extend to the lighting or other equipment being supplied with electrical power. U.S. Pat. No. 4,146,287 shows a typical modular wiring system and shows details of the connectors used in the system.

Ordinarily, five separate conductors are provided in each cable of the wiring system so that five feed-through conductors must be provided in the junction connectors. Electrical taps to the feed-through conductors usually require only three or four conductors so that a typical electrical junction will have three or four tap conductors connected to, and extending from, the feed-through conductors in the junction connector. The tap conductors must be selectively connected to the junction conductors and different combinations of feed-through conductors must be connected to the tap conductors in different electrical taps in a wiring system.

In accordance with the teachings of U.S. Pat. No. 4,146,287, the tap conductors are formed integrally with the feed-through conductors so that for every tap connection a special type of feed-through and tap conductor is required. As a result, a relatively large number of different types of conductors for the junction connector are required to provide every requirement for a wiring system. It would be desirable to have feed-through conductors and tap conductors of standard types which can be assembled to each other in a manner such that any possible combination of connections between the feed-through and tap conductors could be achieved. The present invention, in accordance with one aspect thereof, is directed to the achievement of feed-through and tap conductors which are of standard shapes and sizes but which can be readily connected to each other to yield any desired electrical connections between the tap conductors and the feed-through conductors in the junction connector.

The tap connector which is coupled to the junction connector shown in U.S. Pat. No. 4,146,287 has a rectangular cross-section, as does the junction connector. It is convenient in modular wiring systems to arrange the feed-through conductors in the junction connector in side-by-side parallel coplanar relationship and it is also convenient to arrange the tap conductors in the same manner in the tap connector. However, it would be preferable to be able to use cylindrical tap connectors of a size dimensioned to be fitted into standard size openings which are provided in lighting fixtures and other electrical equipment by the equipment manufacturer. When the conductors in the tap connector are arranged in a single row and the tap connector has a rectangular cross-section, it is therefore necessary to use a special adaptor in the lighting fixture or to otherwise mount the tap connector in the fixture. In accordance with the present invention, the ends of the tap conductors are arranged as a non-linear cluster and the terminal ends of these tap conductors can be mated with terminals in a cylindrical tap connector.

A preferred form of feed-through conductor for junction connectors in accordance with the invention, comprises a flat rectangular stamped member of conductive metal having ends which serve as terminals that are mated with complementary terminals in the cable connectors of the system. Three aligned holes are provided in the feed-through conductor and a slot is formed therein which intersects the three holes. The material of the conductor on each side of the slot is coined outwardly from one surface of the conductor so that this material has a generally cylindrical surface adjacent to the holes and on each side of the slot. The tap conductors comprise rods which are dimensioned to be inserted through one of the holes in a feed-through conductor and have a tight interference fit. The presence of the slot in the feed-through conductor and the outward coining of the metal on each side of the slot results in the development of torsional stresses in these coined portions when the end of the tap conductor is inserted through a hole in the feed-through conductor. The torsional stresses produce contact forces at the electrical interface which are substantially in excess of the forces which would be achieved with a simple punched hole for the tap conductor.

The tap conductors are either straight or have an intermediate portion which extends normally of the two ends so that the remote end from the feed-through conductor is offset from the end of the tap conductor which is connected to the feed-through conductor. The use of tap conductors having these offset free ends and the provision of the three holes in each feed-through conductor permits the arrangement of the free ends of the feed-through conductors as a cluster, rather than an aligned array.

DESCRIPTION OF THE DRAWINGS

FIG. 1 is a perspective view of a feed-through and tap conductor in accordance with the invention with the tap conductor exploded from the feed-through conductor.

FIG. 2 is a view similar to FIG. 1, but showing the upper end of the tap conductor connected to the feed-through conductor.

FIG. 3 is a view showing a tap conductor having an offset free end.

FIG. 4 is a view taken along the lines 4—4 of FIG. 2.

FIG. 5 is a plan view illustrating the manner in which the terminal ends of the tap conductors are arranged in a cluster and how these tap conductors extend from the feed-through conductors.

PREFERRED EMBODIMENT OF THE INVENTION

Figure 6:
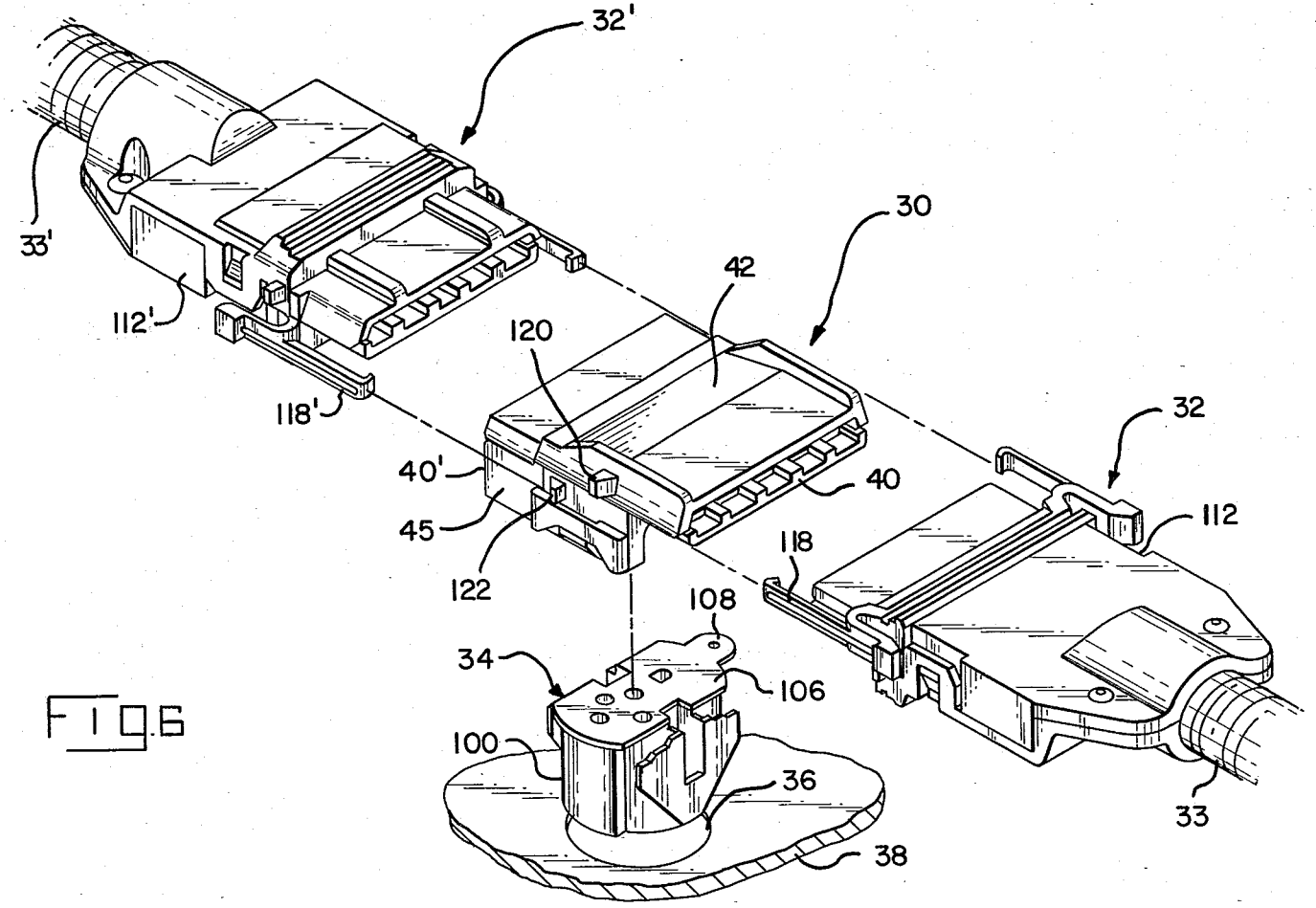
FIG. 6 is a perspective view showing the junction connector, cable connectors, and a tap connector in accordance with the invention.

FIGS. 1–4 show feed-through and tap conductors in accordance with the invention and illustrate the manner in which these conductors are connected and arranged in a junction connector. FIG. 6 shows a specific junction connector 30, which is described in detail in application Ser. No. 249,518, filed Mar. 31, 1981 and this connector will be described to the extent necessary for the full understanding of the present invention. It will be understood that feed-through and tap conductors as described below, can, however, be used in other types of junction connectors.

The feed-through conductor 2 comprises a simple flat rectangular member of conductive metal having ends 8, 8′ which serve as terminals and which are mated with complementary terminals in cable connectors 32, 32′. Each feed-through conductor 2 has ears 10 extending from its side edges for locating the conductor in the connector housing as will be described below. Three aligned openings 12, 14, 16 are provided in the conductor intermediate the ends thereof and an elongated slot 18 is also provided which intersects the openings. The metal on each side of the slot 18 is coined upwardly from the upper surface of the conductor so that a generally cylindrical surface 20 is provided on each side of the slot on the upper surface and a corresponding depression is formed in the lower surface, as shown in FIG. 4. The term "coined" is used to denote a metal-working operation in which the conductor is clamped between two die blocks having cylindrical depression on one side and a projection on the other. The material of the conductor in the vicinity of the slot 18 is thus closely confined while the coining operation is being carried out and a high degree of dimensional precision is achieved in the finished conductor. As shown in FIG. 4, after the coining operation, the opposed edges 21, 21′ of the openings 12, 14, 16 are inclined towards each other.

The tap conductor 4 comprises a cylindrical rod or wire having an upper or first end 22 which is connected to a feed-through conductor by inserting the upper end 22 through one of the openings 12–16. The openings should be dimensioned relative to the diameter of the tap conductor such that a secure and snug interference fit is obtained when the upper end 22 of the tap conductor is inserted through one of the openings. Upon movement of the upper end of the conductor 4 through an opening, the metal adjacent to the opening is stressed in torsion and these torsional stresses are established in the four sections of the coined portion 20 which surround the opening through which the tap conductor extends. The stresses can be regarded as torsional stresses for the reason that the metal adjacent to the slot is flexed upwardly when the tap conductor is inserted into the opening, the amount of flexure decreasing with increasing distance from the opening. The development of these torsional stresses results in turn, in the development of high contact forces at the electrical interface between the upper end 22 of the tap conductor and the opening in the feed-through conductor. Moreover, the electrical connection is established by merely moving the upper end 22 of the conductor 4 through the opening, an operation which does not require specialized tooling or a high degree of skill.

A junction connector 30 will have a plurality, usually five, feed-through conductors 2 therein in side-by-side parallel relationship. Three, four, or five of the feed-through conductors 2 will be connected to tap conductors at an electrical tap in the system. In order to arrange the lower ends 24 of the tap conductors in a cluster as shown at 34, FIG. 5, tap conductors of the type shown at 6 are used. The tap conductor 6 has a lower end portion 24 which is offset from the upper end 22, the two end portions being connected by a laterally extending intermediate section 26.

Referring to FIG. 5, it can be seen that the lower ends 24 of the tap conductors can be arranged as a cluster lying within the circular area 34 indicated by using tap conductors 6 having intermediate offset portions 26 in combinations with straight tap connections as shown at 4 in FIG. 1. The provision of the three openings 12, 14, 16 permits one or more of the feed-through conductors to be used with a tap conductor of the type shown at 6 in a manner such that the ends 24 of the tap conductors can all be confined to a circular zone. The lower ends 24 of the tap conductors can thereby be connected to terminals in a generally cylindrical tap connector, as shown at 34 and as will be described below.

FIG. 6 shows the connectors required for a typical electrical junction in a modular wiring system. The junction connector 30 is coupled to the cable connectors 32, 32′ which are installed on the ends of electrical cables 33, 33′. The junction connector is also coupled to a cylindrical tap connector 34 which is mounted in a circular opening 36 in a panel 38. The panel may be the housing panel of a fluorescent ceiling fixture or a similar electrical device.

Junction connector 30 comprises an insulating housing assembly having oppositely directed first and second mating faces 40, 40′. The housing has upper and lower sidewalls 42, 44 and oppositely facing endwalls 45. A third mating face 46 is provided on the lower sidewall for the tap connector 34 as shown best in FIG. 10.

Figure 7:
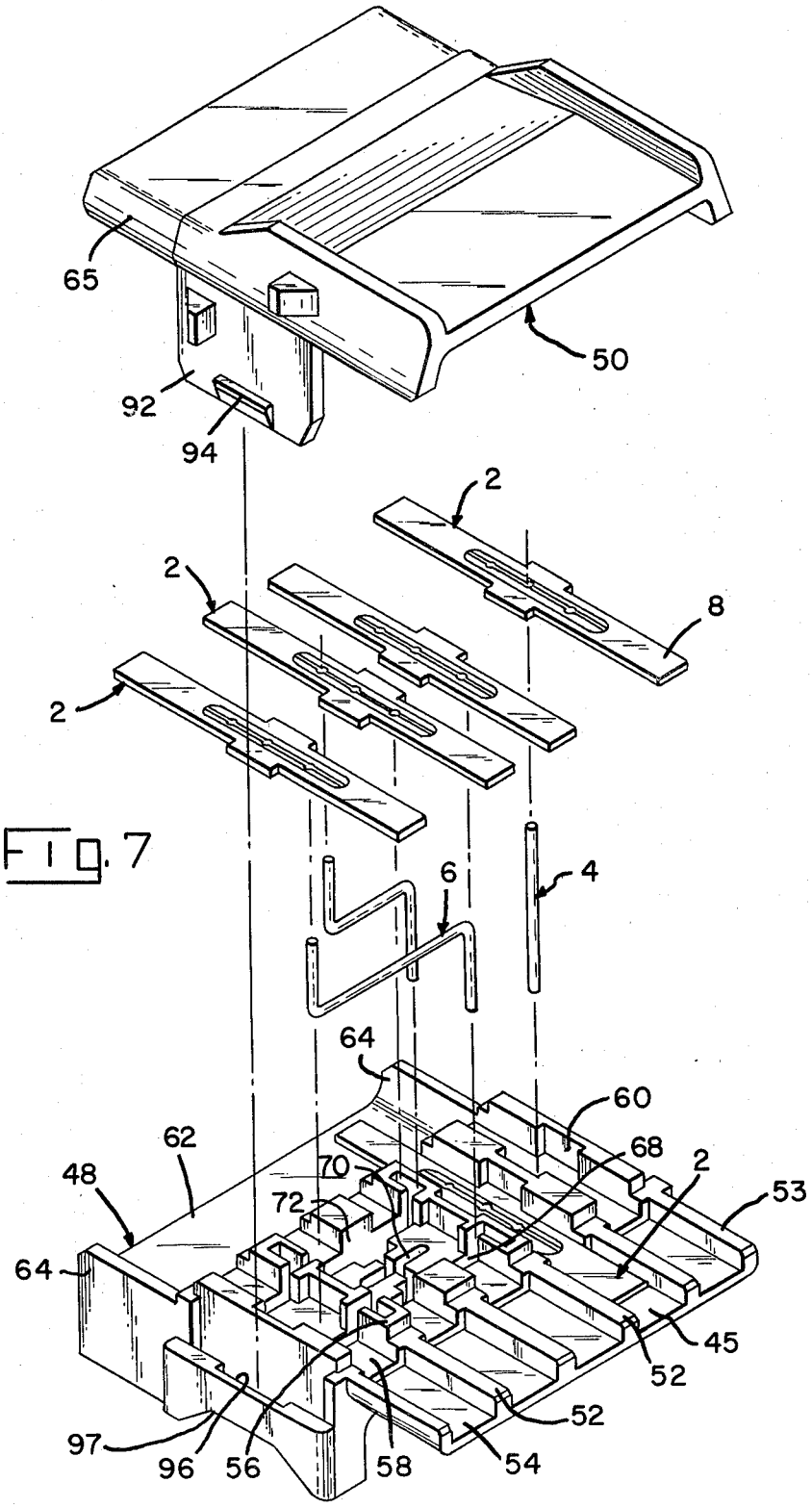
FIG. 7 is a perspective view of a junction connector having the cover member exploded from the body of the connector and showing feed-through and tap conductors exploded from the junction connector body.

The housing assembly comprises a housing body 48, FIG. 7, and a cover member 50. The housing body has at its left hand end a projecting flat portion having spaced-apart barriers 52 on its upper surface and having flanges 53 extending from its side edges. Individual stalls 54 are formed by the barriers 52 which receive the feed-through conductors 2 and the central portions or floors of the stalls are elevated, as shown at 58, so that the ends 8 of the conductors 2 are above the lower surfaces or floors of the stalls. The central portions of the barriers are also elevated, as shown at 56 and the stalls are enlarged laterally in these central portions at 60, to receive the ears 10 on the side edges of the feed-through conductors 2. The lefthand portion of the body 48 comprises an apron 62 which functions as a hood for the mating face 40' of the housing assembly. This hood has side flanges as shown at 64, which cooperate with side flanges 65 on the cover member to form an enclosure around the end portions 8' of the feed-through conductors.

Figure 10:
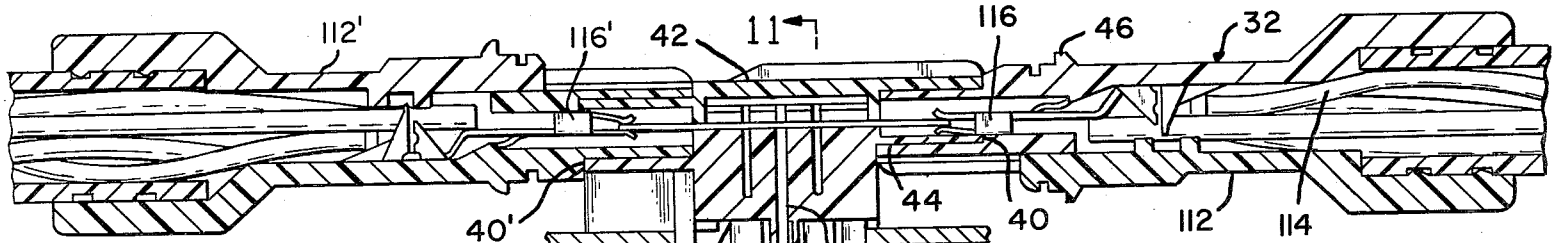
FIG. 10 is a sectional view taken through a junction connector in accordance with the invention and through cable connectors mated with the junction connector.
Figure 11:
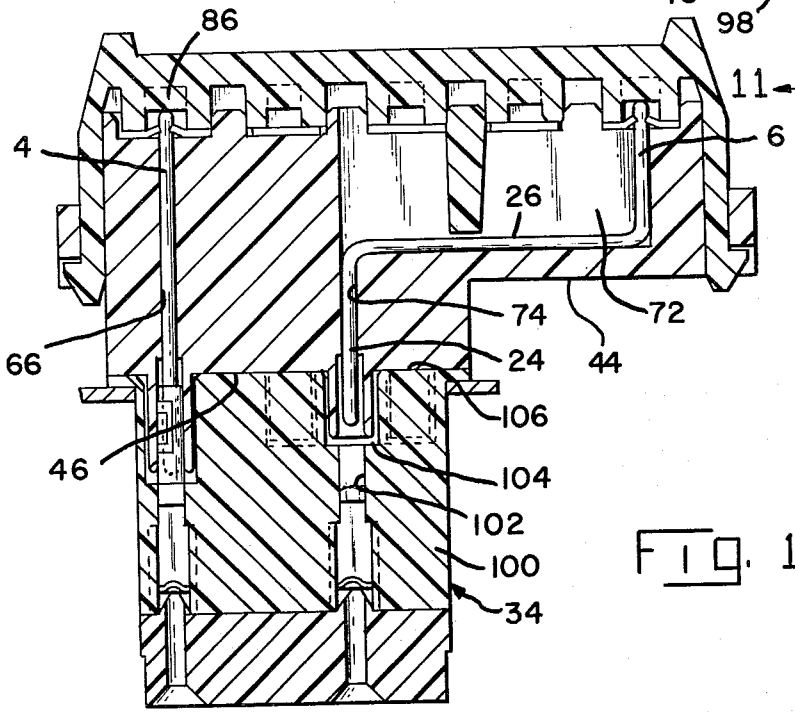
FIG. 11 is a view taken along the lines 11—11 of FIG. 10.

Openings 66, FIG. 11, extend through the housing body from the floors of the stalls to the third mating face 46, these openings being dimensioned to receive the straight tap conductors 4. As shown in FIG. 10, the lower ends 24 of the tap conductors are received in cylindrical projections 98 extending from the face 46.

Three recesses 68, 70, 72 extend inwardly from the upper surface of the housing body, as viewed in FIG. 7, and transversely of the stalls 54. The recesses 68, 72 have laterally extending portions 69 which receive clamping members as will be described below.

Additional holes 74 extend from these recesses to the mating face 46. As shown in FIG. 11, the recesses 68, 72 accommodate a tap conductor of the type shown at 6 having an intermediate laterally extending portion 26. In FIG. 11 then, the feed-through conductor on the right in this figure, is connected to a tap conductor 6 and the intermediate portion 26 of this tap conductor extends to a through hole 74 which accommodates the lower end 24 of the tap conductor. FIG. 11 thus demonstrates that the two through conductors which are on the right hand side of this figure can be connected by means of tap conductors 6 to terminals in the cylindrical tap connector which terminals are arranged in a cluster in the tap connector. The three recesses 68, 70, 72 are provided in order to permit the realization of a variety of arrangements or patterns involving the through conductors and the tap conductors.

Figure 8:
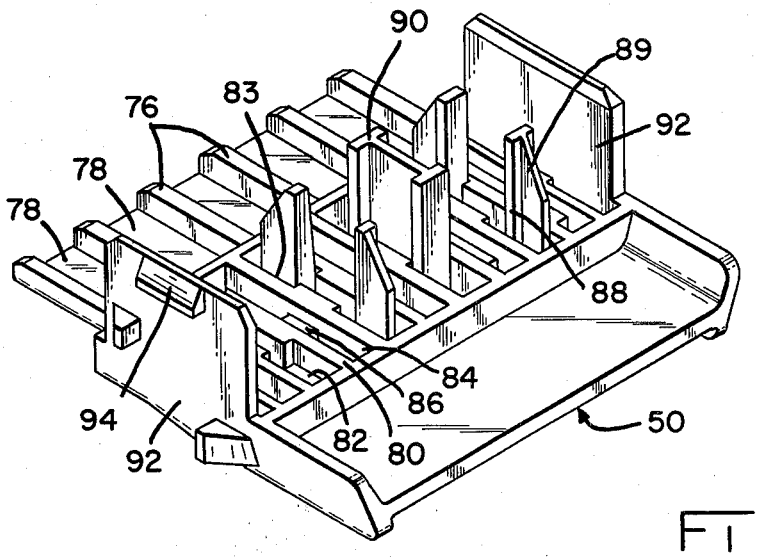
FIG. 8 is a perspective view of the underside or internal surface of the cap or cover member of the junction connector housing.
Figure 9:
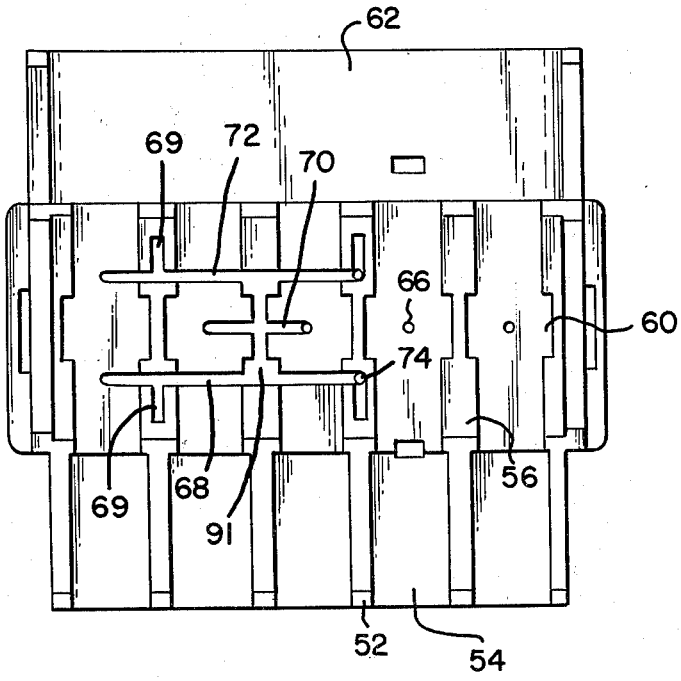
FIG. 9 is a plan view of the junction connector housing body.

As shown in FIG. 8, the cover 50 has at its lefthand end a flat projecting portion having spaced-apart barriers 76 on its surface which define spaced-apart stalls 78. These stalls receive the end portions 8' of the through conductors 2 in the same manner as the stalls 54 receive the ends 8. The central portion 80 of the housing cover has recesses 82, 84 therein, the recesses being separated by barriers as shown at 83. The surfaces of these barriers bear against the through conductors 2 when the cover member is assembled to the body member and clamp the through conductors against the raised central sections 58 of the stalls in the body portion. The stalls 84 have centrally located stops therein, as shown at 86 and these stops bear against the upper ends of the tap conductors 4, 6, as shown in FIG. 11.

The intermediate portions 26 of the tap conductor 6 are securely clamped in the recesses 68, 70, 72 by means of holddown columns or projections 88, 90. The projections 88 are dimensioned to enter the recesses 68, 72, the strengthening ribs 89 on these clamping members being received in the previously identified portions 69 of the recesses. The clamping member 90 is generally I-shaped and is dimensioned to extend across the recess 70 and to be received in portions 91 of the recesses 68, 72.

The cover member is secured to the body 48 by means of locking flanges 92 having ears 94 on their outwardly facing surfaces. The locking flanges are received in openings 96 on the endwalls 45. These openings are formed by U-shaped locking members and are dimensioned such that the ears will engage the lower edges 97 of these members as shown best in FIG. 6.

The tap connector comprises a generally cylindrical housing 100 having cavities 102 extending therethrough from the mating face 106 of the housing. These cavities are enlarged adjacent to the mating face, as shown at 104, to receive the cylindrical projections 98 on the junction connector housing body. The tap connector housing 100 may be secured to the panel 38 by means of an ear 108 through which a screw is passed, as shown in FIG. 6. Also, integral latching or securing ears may be provided on the tap connector housing to secure it to the panel 38, as fully described in the above identified application Ser. No. 249,518 filed Mar. 31, 1981.

The junction connector 30 is coupled to the tap connector 34 by merely moving the junction connector downwardly from the position shown in FIG. 6, until the mating faces 106, 46 of the tap connector and the junction connector are against each other. The junction connector housing has latch arms 110 which extend through the opening 36 and engage the panel on its underside, as shown in FIG. 10.

The cable connectors 32, 32' each comprise an insulating housing containing terminals 116, 116' which are electrically connected to the ends of the cable conductors 114, see FIG. 10. The cable connector housings have latch arms 118 which cooperate with ears 120, 122 on the junction connector housing assembly to secure the cable connectors to the junction connectors. Cable connectors, as shown in FIG. 6, are also described in the above identified application Ser. No. 249,518 filed Mar. 31, 1981 and are also described in application Ser. No. 233,543 filed Feb. 11, 1981.

The junction connector in accordance with the invention is assembled by selecting the desired combination of straight tap conductors 4 and tap conductors 6 having offset lower ends, placing the tap conductors 6 in the appropriate recesses 68, 70, 72, placing the straight conductors 4 in the holes 66, and then positioning through conductors 2 in the housing body, as shown at FIG. 7. The feed-through conductors 2 are then positioned in the housing body 48. The cover member 60 is then assembled to the body 48 and during assembly, the stops 86 will move against the upper ends of the tap conductors and the surface portions 80 of the cover member will move against the through conductors 2. The upper ends of the tap conductors will then be moved relatively through the openings in the feed-through conductors and the feed-through conductors will be pressed or clamped against the central portions 58 of the stalls 54. The electrical connections between the tap conductors and the feed-through conductors are thus established by the act of assembling the cover member of the housing to the housing body. It is, of course, necessary to support the lower ends of the tap conductors during assembly against movement while the cover is being assembled to the housing body.

Figure 12:
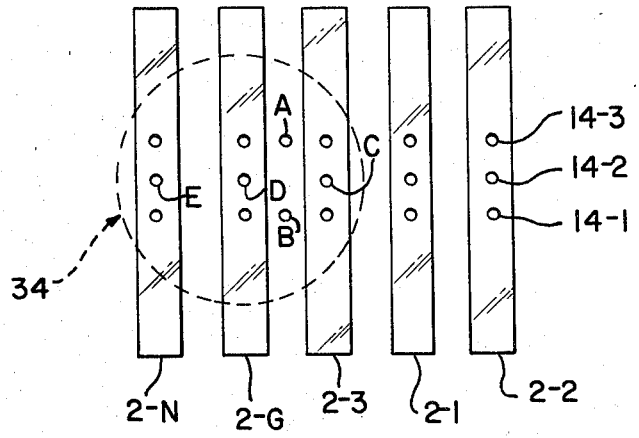
FIG. 12 is a diagrammatic view showing the locations of the feed-through conductors relative to the location of the tap connector.
Figure 13:
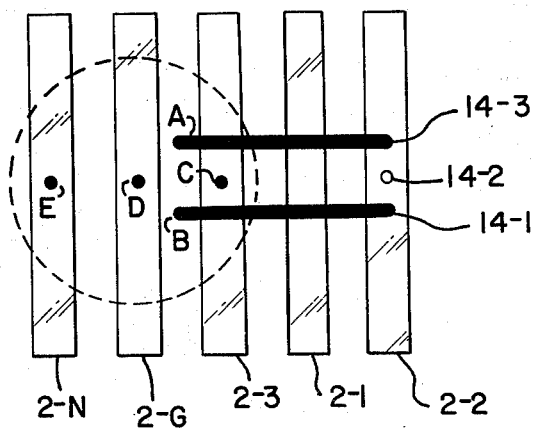
FIGS. 13 and 14 are views similar to FIG. 12 illustrating the manner in which the individual feed-through conductors can be connected to terminals in the tap connector.
Figure 14:
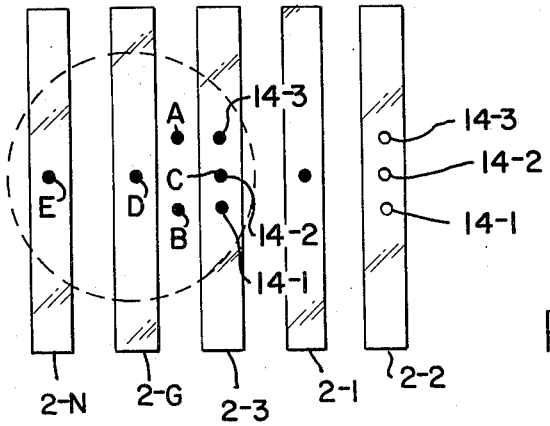

FIGS. 12–14 illustrate the wide choice of options available in connecting the feed-through conductors 2 to the terminals in the tap connector. FIG. 12 shows the location of the feed-through conductors 2 and the tap connector 24. No tap conductors 4, 6, are shown in FIG. 12 and the tap conductors are indicated in FIGS. 13 and 14 by the black dots (straight tap conductors 4) and the heavy lines (tap conductors 6 having offset intermediate portions). The feed-through conductors 2 are specifically identified by the reference characters 2-N, 2-G, 2-1, 2-2, and 2-3. The conductors 2-N and 2-G represent ground and neutral conductors in the system and are located adjacent to each other on the lefthand side of the group of five conductors. The conductors 2-1, 2-2, and 2-3 are the current conductors which carry current in the system to the lighting units or other electrical loads. The individual openings 14 in each feed-through conductor are specifically identified by the reference numerals 14-1, 14-2, and 14-3. The terminal receiving cavities 102 in the tap connector 38 are identified by the letters A, B, C, D, and E.

FIGS. 13 and 14 illustrate the locations of tap conductors 4 and 6 in a connector serving to connect predetermined feed-through conductors 2 to predetermined positions in the tap connector 34. In all cases, the feed-through conductors 2-N and 2-G are connected to straight tap conductors 4 and these tap conductors extend through the central openings 14-2 in the feed-through conductors 2-N, 2-G. Also in FIG. 13, the conductor 2-3 has a straight tap conductor 4 extending through its central opening 14-2 and to position C in the tap connector 34. The feed-through conductor 2-2 in FIG. 13 has two tap conductors of the type shown at 6 connected thereto and these tap conductors have their upper ends 22 extending through the openings 14-1 and 14-3 in the feed-through conductor 2-2. The lower ends 24 of the tap conductors 26 in FIG. 13 extend to positions A and B in the tap connector 34. It will thus be apparent that no current is drawn from the feed-through conductor 2-1 shown in FIG. 13, but current is drawn from the feed-through conductors 2-2 and 2-3.

FIG. 14 shows an alternative tap circuit in which the neutral and ground conductors 2-N and 2-G have straight tap conductors 4 extending through their central openings 14-2. These straight conductors extend to positions D and E in the tap connector 34, as they do in the embodiment of FIG. 13. The conductor 2-3 has tap conductors 6 extending through the openings 14-1 and 14-3 and the lower ends of these tap conductors extend to positions A and B in the tap connector 14. It will be apparent that the tap conductors used in FIG. 14 will have a shorter intermediate portion 26 than the tap conductors required for the embodiment of FIG. 13. The feed-through conductor 2-1 in FIG. 14 also has a tap conductor having an offset lower end connected to its opening 14-2 and the lower end of this tap conductor extends to position C in the tap connector 34. In this embodiment, no current is drawn from the conductor 2-2.

It will be apparent that the positions A, B, and C of the tap connector 34 can be connected to any of the feed-through conductors 2-1, 2-2, and 2-3 by using the proper size tap conductors 6, that is, tap conductors having intermediate portions 26 of the required length.

What is claimed is:

1. An electrical junction connector of the type comprising an insulating housing having oppositely directed first and second mating faces and having a third mating face which is directed laterally of said first and second mating faces, a plurality of parallel feed-through conductors extending between said first and second mating faces and a plurality of tap conductors, each of said tap conductors being connected to one of said feed-through conductors intermediate the ends thereof and extending from said feed-through conductor to said third mating face, said electrical connector being characterized in that:

each of said feed-through conductors comprises an elongated flat stamped member of conductive metal, said feed-through conductors being in parallel side-by-side coplanar relationship, each of said feed-through conductors having a tap conductor receiving opening extending therethrough intermediate its ends, said opening having opposed arcuate edges, each of said tap conductors comprising a rod-like member having a uniform cross-section along its length, each rod-like member having a first end which is inserted through said opening in its associated feed-through conductor from one surface thereof and beyond the other surface, said tap conductor having an interference fit in said opening whereby said tap conductor is electrically connected to said feed-through conductor, each of said rod-like members having a second end located at said third mating face.

2. An electrical junction connector as set forth in claim 1, each of said feed-through conductors having at least one slot therein extending from said opening partially along the length of the flat stamped member, a portion of the metal of said member which surrounds said opening and said slot being coined to a generally cylindrical shape with the convex surface of said cylindrical shape merging with said other surface of said member.

3. An electrical junction connector as set forth in claim 1, each of said feed-through conductors having a slot extending axially therein, said opening being on the axis of said slot whereby portions of said slot extend from said opening at diametrically opposite locations, a portion of the metal of said member which surrounds said opening and said slot being coined to a generally cylindrical shape, the convex surfaces of said cylindrical shape merging with said other surface of said member.

4. An electrical junction connector as set forth in claim 3, each of said feed-through conductors having a plurality of said openings therein, all of said openings being intersected by said slot, each of said tap conductors extending through a pre-selected opening in its associated feed-through conductor, at least one of said tap conductors having its first end out of alignment with the first ends of the remaining tap conductors.

5. An electrical junction connector as set forth in claim 3, said housing having five of said feed-through conductors therein, each of said feed-through conductors having three of said openings therein, corresponding openings in said feed-through conductors being in alignment, at least two of said tap conductors comprising straight rod-like members extending from said feed-through conductors to said third mating face, said second end of at least one of said tap conductors being laterally offset from said first end thereof, said second ends of said tap conductors being arranged in a cluster at said third mating face.

6. An electrical junction connector as set forth in claim 5, said straight tap conductors having their first ends inserted through corresponding openings in two adjacent feed-through conductors, said at least one tap conductor having its first end inserted through said opening in a feed-through conductor which is not aligned with said corresponding openings in said two adjacent feed-through conductors.

7. An electrical junction connector as set forth in claim 6, one of said feed-through conductors, other than said two adjacent feed-through conductors, being electrically connected to two of said tap conductors.

8. An electrical junction connector as set forth in claim 7, said two tap conductors which are connected to said one feed-through conductor having their second ends non-aligned with said second ends of said straight tap conductors.

* * * * *